US006607055B1

(12) United States Patent
Wu

(10) Patent No.: US 6,607,055 B1
(45) Date of Patent: Aug. 19, 2003

(54) EMERGENCY ESCAPE PULLEY STRUCTURE

(76) Inventor: Lung-Shen Wu, No. 14, Lane 14 Chen-Chiang St Pu-Li Township, Nan-To Hsien (TW)

( * ) Notice: Subject to any disclaimer, the term of this patent is extended or adjusted under 35 U.S.C. 154(b) by 0 days.

(21) Appl. No.: 10/082,725

(22) Filed: Feb. 26, 2002

(51) Int. Cl.[7] ..... A62B 1/00
(52) U.S. Cl. ..... 182/236; 182/239
(58) Field of Search ..... 182/73, 236–240, 182/71, 72, 231–235

(56) References Cited

U.S. PATENT DOCUMENTS 646,635 A * 4/1900 Cabus ..... 182/237
4,327,818 A * 5/1982 Tepsa et al. ..... 182/238
4,416,351 A * 11/1983 Geurtsen ..... 182/238
4,448,284 A * 5/1984 Ciabo ..... 181/234
4,493,396 A * 1/1985 Borgia, V ..... 182/238
4,712,645 A * 12/1987 Shih ..... 182/5

* cited by examiner

*Primary Examiner*—Alvin Chin-Shue
(74) *Attorney, Agent, or Firm*—Harrison & Egbert

(57) ABSTRACT

An emergency escape pulley structure includes a main shaft on which a plurality of rope wheels are mounted. The main shaft actuates a deceleration gear set, so as to link a braking wheel. The rope wheels are controlled by a control member to turn independently on the shaft, thereby enabling two or more persons to use the emergency escape pulley structure at the same time.

1 Claim, 4 Drawing Sheets

EMERGENCY ESCAPE PULLEY STRUCTURE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to an emergency escape device, and more particularly to an emergency escape pulley structure capable of allowing two or more persons to escape at the same time.

BACKGROUND OF THE INVENTION

The conventional emergency escape pulley comprises a spindle and a rope wheel to facilitate the escape of only one person at a time. As a result, the conventional emergency escape pulley is of a little help in a situation in which one or more persons must be evacuated on an emergency basis. It is conceivable that any delay in escape in the emergency situation can often result in a human tragedy.

BRIEF SUMMARY OF THE INVENTION

The primary objective of the present invention is to provide an emergency escape pulley structure capable of evacuating a plurality of persons from an emergency site.

The emergency escape pulley structure of the present invention comprises a main shaft on which a plurality of rope wheels are mounted. The main shaft actuates a deceleration gear set so as to link a braking wheel. The rope wheels are controlled by a control member to turn independently on the main shaft, thereby enabling two or more persons to use the emergency escape pulley structure at the same time.

The features and the advantages of the present invention will be more readily understood upon a thoughtful deliberation of the following detailed description of the present invention with reference to the accompanying drawings.

DETAILED DESCRIPTION OF THE INVENTION

Figure 1:
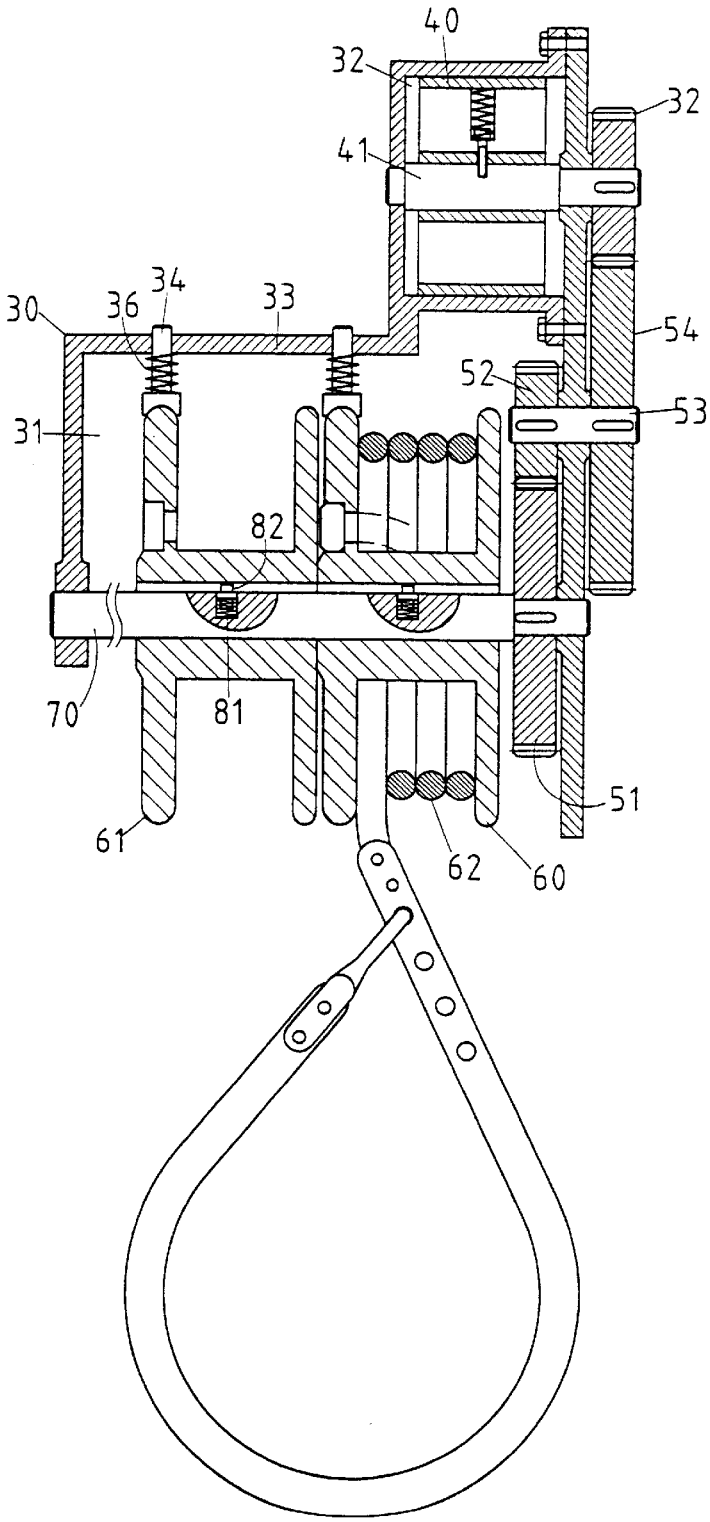
FIG. 1 shows a sectional schematic view of the present invention.
Figure 2:
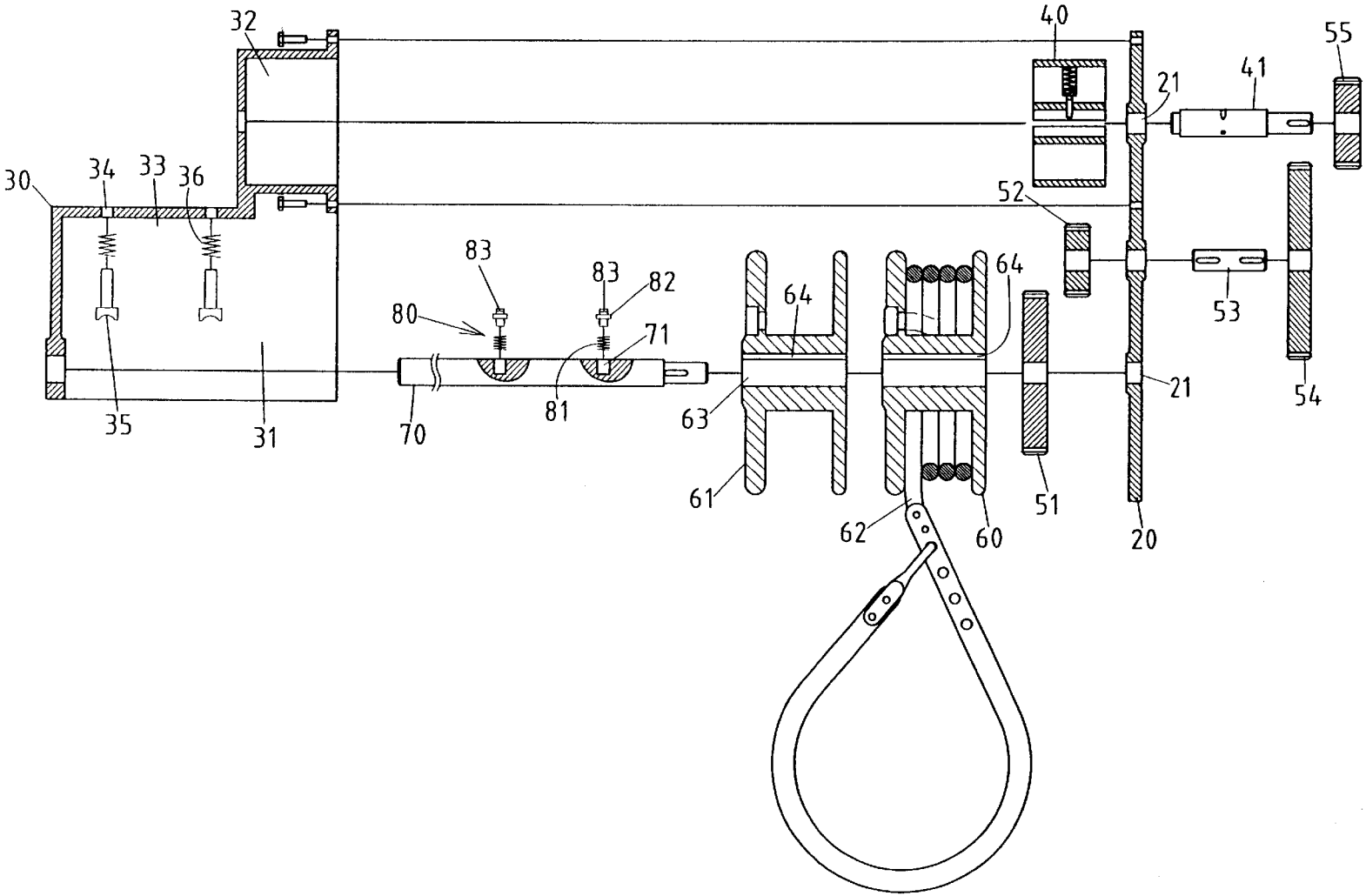
FIG. 2 shows an exploded schematic view of the present invention.
Figure 3:
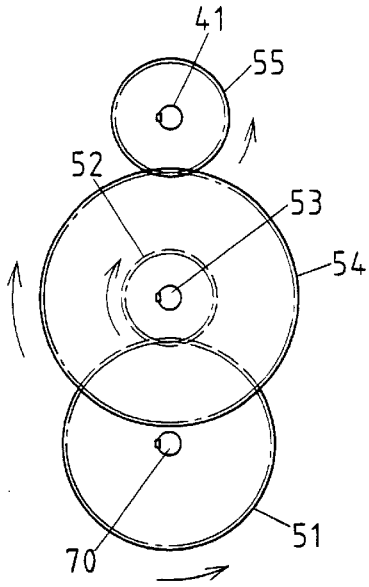
FIG. 3 shows a schematic plan view of the deceleration gear set of the present invention.
Figure 4:
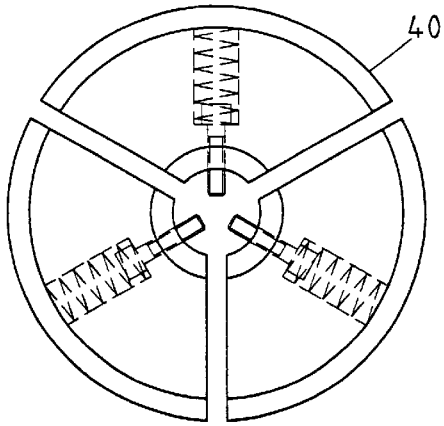
FIG. 4 shows a schematic plan view of the braking wheel of the present invention.
Figure 5:
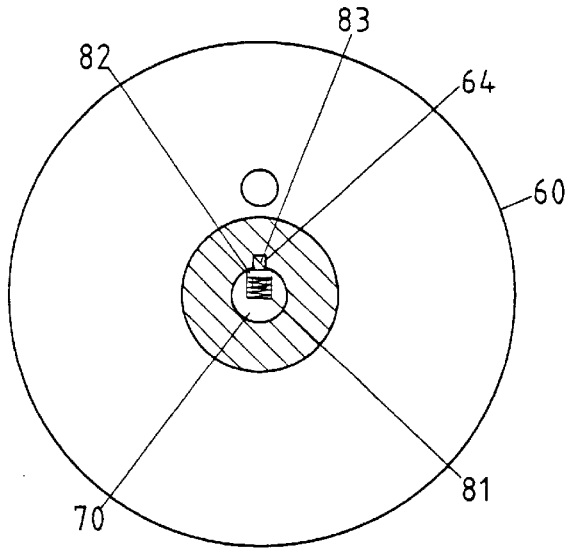
FIG. 5 shows a sectional schematic view of the main shaft and the rope wheel of the present invention.
Figure 6:
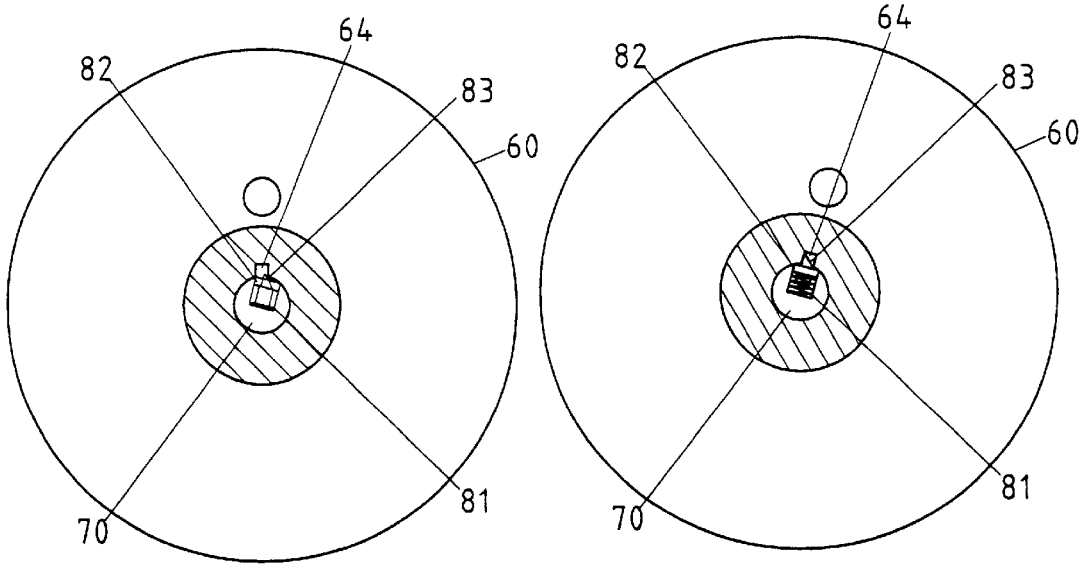
FIG. 6 shows a sectional schematic view of the main shaft and a plurality of rope wheels which are exerted on by an external force.

As shown in all drawings provided herewith, an emergency escape pulley structure embodied in the present invention is formed of a fastening board 20, a housing 30, a braking wheel 40, a deceleration gear set, a plurality of rope wheels 60 and 61, and a main shaft 70.

The fastening board 20 is provided with a plurality of shaft holes 21.

The housing 30 is provided with a lower receiving compartment 31 and an upper receiving compartment 32. The lower receiving compartment 31 is provided in a top wall 33 with a plurality of longitudinally-oriented through holes 34 for receiving a plurality of deceleration rods 35 which are provided at the top end with a spring 36 fitted thereover. The housing 30 is fastened to one side of the fastening board 20.

The braking wheel 40 is located in the upper receiving compartment 32 of the housing 30 by means of a shaft rod 41, with one end of the shaft rod 41 extending out of another side of fastening board 20.

The deceleration gear set is formed of a first gear 51, a second gear 52, a third gear 54, and a fourth gear 55. The first gear 51 is mounted in the lower receiving compartment 31 of the housing 30 and is engaged with the second gear 52. The second gear 52 is mounted on a shaft rod 53 with one end thereof extending out of another side of the fastening board 20 to mount thereon the third gear 54 which is engaged with the fourth gear 55. The fourth gear 55 is mounted on an outer end of the shaft rod 41 on which the braking wheel 40 is mounted.

The rope wheels 60 and 61 are arranged in the lower receiving compartment 31 of the housing 30 in a parallel manner. The rope wheels 60 and 61 are provided with a rope 62 which is wound thereon. The rope wheels 60 and 61 are provided in the center thereof with a through hole 63 which is in turn provided in the inner wall with a horizontal long slot 64.

The main shaft 70 is horizontally disposed and is provided in the outer wall surface thereof with a plurality of transverse slot holes 71 for disposing a control member 80. A spring 81 is disposed in the transverse slot hole 71 such that one end of the spring 81 is fitted over a retaining bolt 82 which is provided with an inclined plane 83. The rope wheels 60 and 61 are mounted on the main shaft 70 such that the top end of the retaining bolt 82 is inserted into the horizontal long slot 64 of the through hole 63 of the rope wheels 60, 61. The main shaft 70 is fastened pivotally at one end with a side wall 37 of the housing 30 such that other end of the main shaft 70 is pivotally fastened with the fastening board 20 via the first gear 51. The bottom end of the deceleration rod 35 comes in contact with the rope wheels 60, 61.

As one of the rope wheels is pulled by the rope 62 to turn, the horizontal long slot 64 pushes the retaining bolt 82 of the control member 80 to link the main shaft 70. In the meantime, rope wheel 61 is not pulled by the rope 62. When the main shaft 70 turns, the rope wheel 61 is caused by the inclined plane 83 to remain stationary. The main shaft 70 is caused by rope wheel 60 to turn. As a result, when one rope wheel 60 is being used by a person to escape, another rope wheel 61 is not actuated by the rope wheel 60 in motion. In other words, two persons can escape simultaneously by using the two rope wheels 60, 61. The rope wheels of the present invention may be three, four, or more, depending on the need. As some of the rope wheels in use, the remaining rope wheels are kept stationary by the control members 80.

The present invention described above is to be regarded in all respects as being merely illustrative and nonrestrictive. Accordingly, the present invention may be embodied in other specific forms without deviating from the spirit thereof. The present invention is therefore to be limited only by the scope of the following claim.

I claim:

1. An emergency escape pulley structure comprising:

a fastening board comprised of a plurality of shaft holes;

a housing comprised of a lower receiving compartment and an upper receiving compartment, said lower receiving compartment being provided in a top wall with a plurality of vertically-oriented through holes for receiving a plurality of deceleration rods which are to provided at a top end with a spring fitted thereover, said housing being fastened to one side of said fastening board;

a braking wheel located in said upper receiving compartment of said housing by a first shaft rod, with said first shaft rod having one end extending through one side of said fastening board;

a deceleration gear set comprised of a first gear, a second gear, a third gear, and a fourth gear, said first gear being mounted in said lower receiving compartment of said housing such that said first gear is engaged with said second gear which is mounted on a second shaft rod with one end thereof extending out of another side of said fastening board to mount thereon said third gear, with said third gear being engaged with said fourth gear which is mounted on an outer end of said first shaft rod;

a plurality of rope wheels, which are arranged in said lower receiving compartment of said housing in a parallel manner and are provided with a rope wound thereon, said rope wheels being provided in a center thereof with a through hole which is in turn provided in an inner wall with a horizontal long slot; and a main shaft disposed horizontally and provided in an outer wall surface with a plurality of transverse slot holes for disposing a control member each of said transverse slot holes holding a spring whose one end is fitted over a retaining bolt, said retaining bolt being provided with an inclined plane at a top end thereon said main shaft being used to mount thereof said plurality of rope wheels such that a top end of each of said retaining bolts is inserted into said horizontal long slot of said through hole of said rope wheels, said main shaft being fastening pivotally at one end with a side wall of said housing such that another end of said main shaft is pivotally fastened to said fastening board via said first gear, said rope wheels being in contact with a bottom end of said deceleration rod.

* * * * *